US006457902B1

(12) United States Patent
Artzberger et al.

(10) Patent No.: US 6,457,902 B1
(45) Date of Patent: Oct. 1, 2002

(54) TRUSS SCREED WITH COVERED VIBRATOR SHAFT

(75) Inventors: Thomas G. Artzberger, Hartford; Gregory S. Dombek, Germantown, both of WI (US)

(73) Assignee: Wacker Corporation, Menomonee Falls, WI (US)

( * ) Notice: Subject to any disclaimer, the term of this patent is extended or adjusted under 35 U.S.C. 154(b) by 0 days.

(21) Appl. No.: 09/813,661

(22) Filed: Mar. 20, 2001

(51) Int. Cl.[7] ..... E01C 19/38
(52) U.S. Cl. ..... 404/75; 404/114; 404/118
(58) Field of Search ..... 404/102, 114, 404/118, 119

(56) References Cited

U.S. PATENT DOCUMENTS

| | | | | | |
|---|---|---|---|---|---|
| 4,340,351 | A | * | 7/1982 | Owens | 264/69 |
| 4,349,295 | A | * | 9/1982 | Morrison | 404/114 |
| 4,349,328 | A | * | 9/1982 | Allen | 404/119 |
| 4,363,618 | A | | 12/1982 | Allen | |
| 4,427,358 | A | * | 1/1984 | Stilwell | 404/119 |
| 4,466,757 | A | | 8/1984 | Allen | |
| 4,586,889 | A | | 5/1986 | Krohne et al. | |
| 4,685,826 | A | | 8/1987 | Allen | |
| 4,701,071 | A | * | 10/1987 | Morrison | 404/114 |
| 4,741,643 | A | | 5/1988 | Allen | |
| 4,798,494 | A | | 1/1989 | Allen | |
| 4,832,525 | A | * | 5/1989 | Morrison | 384/901 |
| 5,540,519 | A | * | 7/1996 | Weber | 15/235.4 |
| 5,664,908 | A | * | 9/1997 | Paladeni | 404/103 |
| 5,871,302 | A | | 2/1999 | Carlson | |

OTHER PUBLICATIONS

Wacker Corporation, Vibratory Truss Screeds.
Allen Engineering Corporation, *Riding Trowels*, http://www.alleneng.com, (Dec. 7, 2000).

* cited by examiner

*Primary Examiner*—Gary S. Hartmann
(74) *Attorney, Agent, or Firm*—Boyle Fredrickson Newholm Stein & Gratz S.C.

(57) ABSTRACT

A truss screed includes a shaft guard that covers the screed's exciter shaft to protect it from concrete and debris and that protects the surroundings from the rotating exciter shaft. The shaft guard includes a plurality of tubing sections that surround the shaft and that are supported on joints disposed between the guard sections. In a first preferred embodiment of the shaft guard, each joint includes a resilient spring ring, a support cup that receives the spring ring and an end of an associated tubular section, and a bearing that engages the support cup and that supports the joint and a portion of the exciter shaft on the screed's frame. In a second preferred embodiment, each joint includes a support cup that supports an end of the associated tubular section, a bearing, and a U-shaped bracket that couples the support cup to the bearing. The bearing and/or the bracket have elongated slots therethrough for accommodating misalignment of joint components. Joints located at a juncture between adjacent screed sections also include a cup guide that bears the associated support cup while permitting limited tilting movement of the support cup relative to the bearing. Hence, both types of joint accommodate component misalignment, provide an at least limited seal, and permit adjustment of the angular orientation of adjacent screed sections relative to one another.

22 Claims, 10 Drawing Sheets

TRUSS SCREED WITH COVERED VIBRATOR SHAFT

FIELD OF THE INVENTION

The invention relates generally to concrete finishing devices and, more particularly, to truss screeds.

DESCRIPTION OF THE RELATED ART

Truss screeds are widely used to level and preliminarily finish freshly poured concrete. A typical truss screed includes at least one screed plate and a triangular truss frame that supports the screed plate and other components of the machine. The ends of the screed plate are configured to be supported on an upper edge of a form surrounding a slab of freshly-poured concrete. In use, the screed is pulled along the form, either by a manually operated or power operated winch, so that the screed plate pushes the formed concrete ahead of it to level the concrete. Oftentimes, the screed is sectional. That is, it consists of modular sections that are connected to one another in an end-to-end fashion. Sections can be added or removed as desired to change the effective length of the screed, thus permitting the screed to be used on concrete slabs of variable widths. The relative angular orientation of the various sections can also be adjusted to alter the profile of the leveled concrete, e.g., to impart a crown or a slant to the leveled surface. Vibrational forces can be imparted to the screed plate during a concrete leveling operation. Vibration during screeding helps settle and densify the concrete. Vibrational screeding also removes air voids from the concrete and brings excess water and fine layers of concrete aggregated to the surface, hence partially finishing the leveled concrete. Vibrational forces are typically imparted using an exciter shaft that is located near the screed plate and that is driven to rotate via a motor such as an internal combustion engine. The exciter shaft supports eccentric weights that generate vibrations upon exciter shaft rotation. The vibrations are transmitted to the screed plate through the exciter shaft and its bearings.

A problem with traditional truss screeds is that the exciter shaft and associated bearings are not covered. They therefore are exposed to the wet concrete and, therefore, become soiled with concrete and debris. This soiling shortens the life of the bearings and other moving components of the screed.

To address these drawbacks, at least one proposal has been made to provide a shaft guard. However, the proposal proved unworkable because the shaft guard was complex and expensive. Additionally, the proposed shaft guard could not easily accommodate misalignment of the components during assembly thereof or flexing of the screed during angular adjustment of the screed sections for setting the profile of the leveled surface. It was also designed solely for use in a screed in which the exciter shaft is located well-above the screed plate. It also formed the uppermost structural element of the triangular truss frame.

Thus, there is a need to have a shaft guard that is easy to assembly, is relatively flexible, is self-retaining, and provides at least some sealing for the shaft. This need is particularly evident, yet particularly difficult to address, when the exciter shaft is located closely adjacent the concrete being leveled.

SUMMARY OF THE INVENTION

The invention, which is defined by the claims set out at the end of this disclosure, is intended to solve at least some of the problems noted above.

In accordance with a first aspect of the invention, a truss screed includes an improved shaft guard that is configured to cover the exciter shaft and eccentric weights of the screed's exciter assembly. The shaft guard includes (1) tubing sections that surround the shaft and (2) joints that support the sections of tubing on the screed. The tubing may comprise simple plastic tubes formed from PVC or another suitable material. Each joint is sufficiently flexible and otherwise configured to accommodate component misalignment, facilitate assembly, and provide an at least quasi-seal.

In a first preferred embodiment of the shaft guard, the flexible joint includes a support cup and a spring ring made of a resilient material. The support cup supports the spring ring and the associated tubing section end on the bearing. The resilient spring ring is located axially between an end of the associated tubing section and an abutment surface on the support cup. The spring ring permits movement of the tubing section relative to the support cup while providing a seal against the ingress of dust, concrete, etc.

In a second embodiment of the shaft guard, each joint includes a bracket that fits over a bearing. The bearing and bracket are connected to the support cup via a cup.

Elongated slots may be provided in the base of the bracket and the bearing to provide flexibility and movement during assembly of the shaft guard components. Joints located at a juncture between adjacent screed sections also include a cup guide that bears the associated support cup while permitting limited tilting movement of the support cup relative to the bearing.

Hence, both types of joint accommodate component misalignment, provide an at least limited seal, and permit adjustment of the angular orientation of adjacent screed sections relative to one another.

These and other features and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout and in which.

Figure 2:
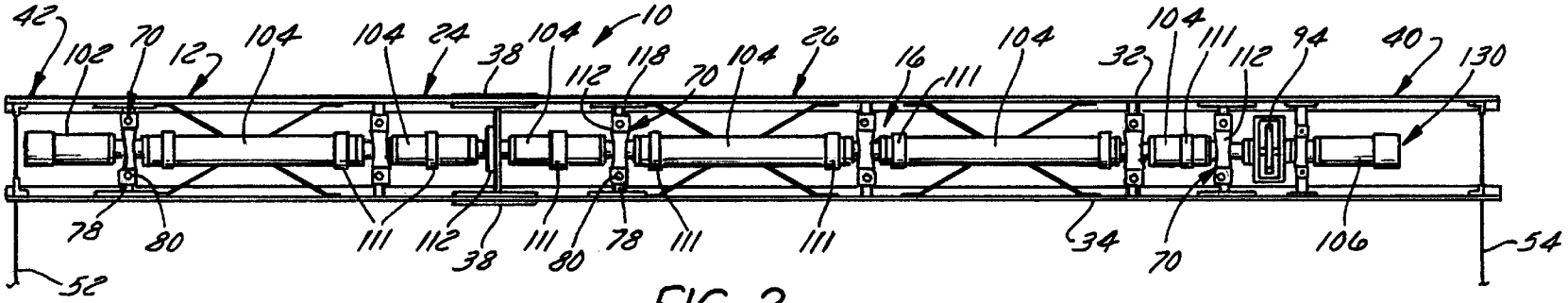
FIG. 2 is a partially schematic, sectional top plan view of the truss screed of FIG. 1, taken generally along the lines 2—2 in FIG. 1.

Before explaining embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

1. Resume

Pursuant to the invention, a truss screed is provided that includes an exciter shaft that is covered with an improved shaft guard that is relatively easy to assembly but that still permits angular adjustment of the various sections of the truss screed relative to one another for the purposes of setting a desired profile on the concrete slab. The exciter shaft includes eccentric weights positioned therealong. The shaft guard includes (1) sections of tubing for covering the exciter shaft and (2) joints that support the ends of the tubing sections on the truss screed's frame. The shaft guard protects the exciter shaft and associated components from concrete and debris. The joints accommodate misalignment between adjacent tubing sections and permit angular adjustment of the screed sections. In a first preferred embodiment of the shaft guard, each joint includes a support cup that supports an associated tubular section end on a bearing for the exciter shaft. At least some of the joints also include a spring ring that is made of a resilient material and that permits limited movement of the associated tubular section relative to the associated support cup. In a second preferred embodiment, the spring rings are eliminated in favor of a bracket assembly that is connected to the support cup and that is mounted on an exciter shaft bearing. Elongated slots in the base of the bracket and/or the bearing provide tolerance to component misalignment during assembly. Joints located at junctions between adjacent screed sections also incorporate structures that permit movement of one of the tubular sections relative to the associated bearing, thereby permitting relative angular adjustment of the screed sections.

2. System Overview

Figure 1:
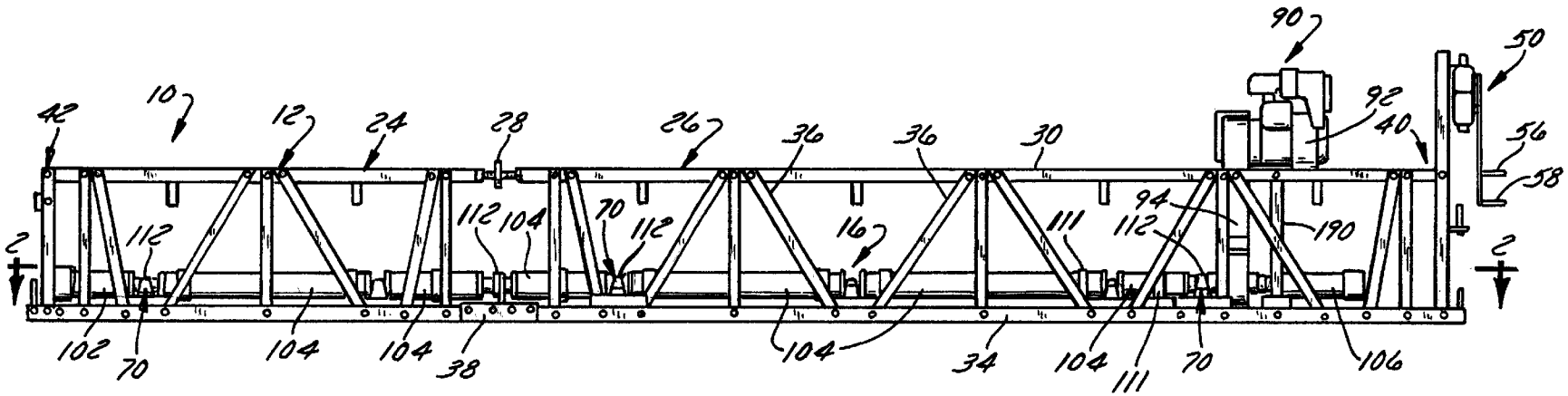
FIG. 1 is a front plan view of a truss screed incorporating a shaft guard constructed in accordance with a first preferred embodiment of the invention.
Figure 3:
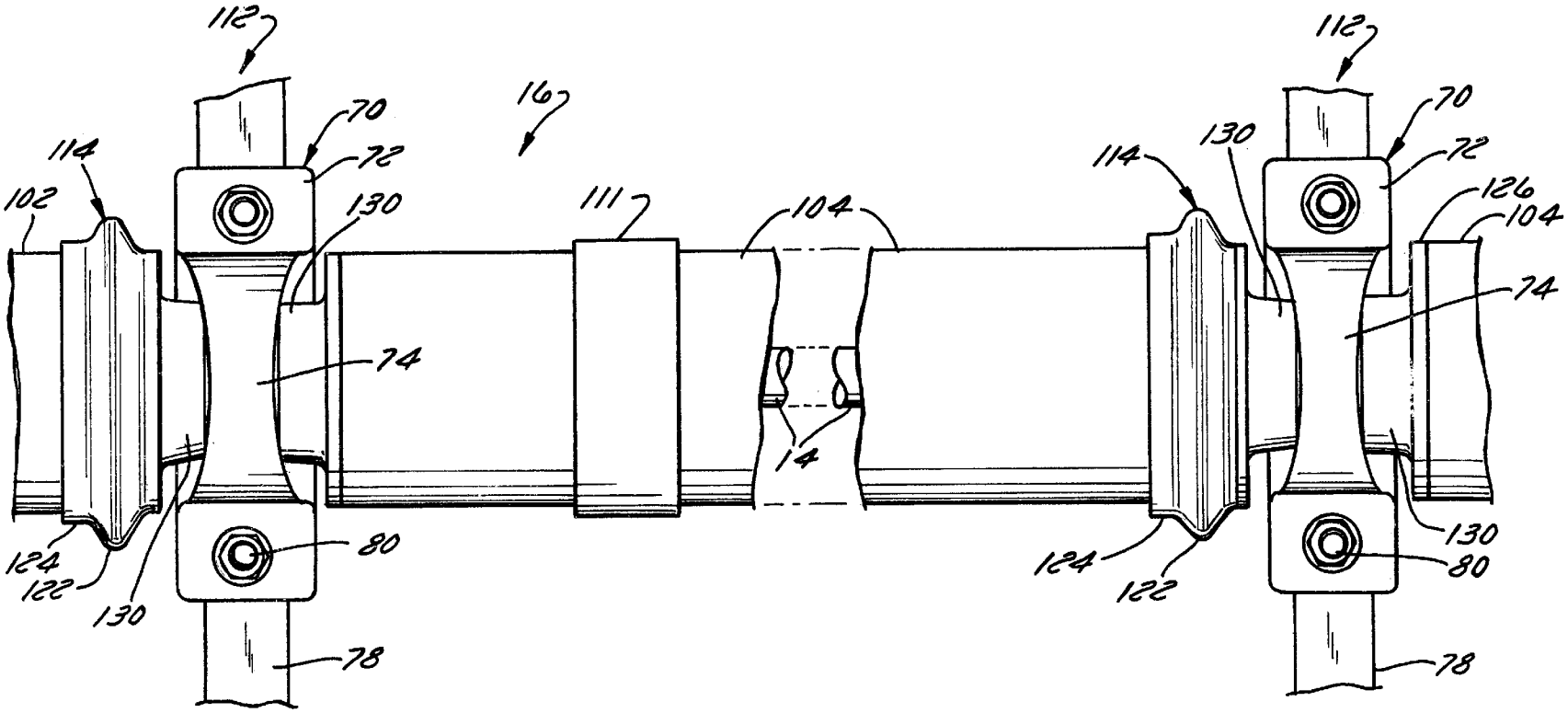
FIG. 3 is a fragmentary top plan view of an inside section of the shaft guard of the truss screed of FIG. 2.

In the drawings, a first preferred embodiment of the vibratory truss screed in accordance with the invention is illustrated in FIGS. 1 and 2 at the reference numeral 10. The truss screed 10 includes a truss frame 12, an exciter assembly including an exciter shaft 14 (FIG. 3), a plurality of eccentric weights 18 mounted on the shaft 14 and held in place by set screws 17, and a shaft guard 16 that covers the shaft 14 and weights 18.

Preferably, the truss frame 12 is fabricated from aluminum, which makes the truss frame 12 both high-strength and lightweight. The truss frame 12 includes multiple sections, e.g., first and second sections 24, 26, that are attached to one another in an end-to-end fashion. Each truss frame section 24, 26 is essentially triangular in cross section, having a central top tube 30 and bottom rear and front screed plates 32, 34 that are connected to the top rectangular tube 30 by a plurality of angled metal struts 36. As can best be seen in FIG. 2, the screed plates 32 and 34 of each section 24, 26 are held together via an H-shaped connector plate 38 with flange bearings (not shown). The top tubes 30 of each pair of adjacent sections 24, 26 are connected to one another by a turnbuckle 28 which can be operated to provide quick, precise adjustments of the relative angular orientation of the adjacent sections in order to alter or adjust the profile of the leveled concrete. For example, for a flat strike-off, adjustment of the truss frame 12 at the turnbuckle 28 permits straightening of the truss frame 12 when two ends 40, 42 of the truss frame 12 are lower than the middle. Tensile adjustment of the truss frame 12 also makes it possible to impart a slightly curved surface to the concrete, such as a crowned strike-off or an inverted strike-off. The connector plates 38 permit rapid assembly of the sections 24, 26 and provide rigidity for even vibration. Other sections can be added or subtracted as desired for a particular application. Spans of from 50 to 75 feet are common.

A winch system 50 is mounted on the truss frame 12 for pulling the screed 10 across the slab to be leveled. The winch system 50 includes two cables 52, 54 each having a free end connected to a stationary object. The other end of each cable 52, 54 is operably coupled to one of two cranks 56, 58 of the winch assembly 50. Both cranks 56, 58 preferably are located on the same end of the truss frame 12 in order to permit one person to operate the winch system 50 by rotating the cranks 56, 58 to translate the truss frame 12 along the upper edge of a form (not shown). Alternatively, the cranks 56, 58 could be replaced with a motor or even driven by the engine 92 (detailed below).

The exciter shaft 14 extends the length of the bottom of the screed 10 between the screed plates 32 and 34 and parallel with those plates. Bearings 70, located at intervals along the screed 10, support the exciter shaft 14 on the screed frame 12 and transmit vibrations generated by the exciter assembly to the screed plates 32 and 34. Referring to FIGS. 3–7, each bearing 70 includes a base 72 and an upper arcuate body 74. A bore 76, formed through the body 74, is configured to receive and rotatably support the exciter shaft 14. Opposed ends of the shaft 14 are cantilevered so as to permit a cantilevered exciter 18 to be located reasonably close to each end of the truss screed 10. This configuration also enhances the modularity of the screed 10 by permitting the formation of short shaft sections between screed sections, as best seen in FIGS. 1 and 2.

Still referring to FIGS. 3–7, the bearings 70 are mounted on tubular support brackets 78 extending between the screed plates 32 and 34 at spaced-apart locations, preferably corresponding to the locations of the connector plates 38. By mounting the bearings 70 near the level of the screed plates 32, 34, vibration transmission efficiency to the screed plates 32, 34 is maximized. Each bearing 70 is mounted on the associated support bracket 78 by bolts 80 that are inserted through aligned bores in the bearing 70 and the tubular bracket 78 and that are attached to nuts (not shown) on the bottom of the bracket 78. Opposed ends of each of the support brackets 78 are, in turn, attached to the screed plates 32 and 34, thereby supporting the bearings 70 and the exciter shaft 14 on the screed plates 32 and 34. Bearings are located along each screed section and at the ends of each screed sections. The bearings at the interior ends of the screed sections each support the ends of two adjacent shaft sections in a manner that is, per se, well known, thereby permitting shaft sections to be added to or removed from the truss screed 10 as sections are added to or removed from the truss screed 10.

The exciter shaft 14 is driven to rotate via a torque transfer system 90, best seen in FIGS. 1, 6, 7, and 11. The torque transfer system 90 includes a motor 92 and a torque transmitting member 94 that transfers torque from the motor 92 to the exciter shaft 14. The motor 92 may be a conventional, relatively small gasoline powered engine. Electric, hydraulic, or other motors could be employed in place of motor 92 if desired. The torque-transmitting member 94 preferably takes the form of a belt that couples a clutch 96 to a driven pulley 98. The clutch 96 is keyed or otherwise operatively coupled to a drive shaft 100 of the motor 92, and the driven pulley 98 is keyed or otherwise operatively coupled to the exciter shaft 14.

The exciter shaft 14 and eccentric weights 18 are protected by a shaft guard that covers the shaft 14 and associated weights 18. Preferably, the shaft guard should be simple yet versatile enough to accommodate some misalignment of adjacent shaft sections during assembly. The shaft guard should also be flexible enough to accommodate truss frame flexing occurring as a result of frame tension adjustment. Two preferred embodiments of such a guard will now be detailed.

3. First Preferred Embodiment of the Shaft Guard

Referring to FIGS. 1–10, a first preferred embodiment of a shaft guard 16 is illustrated. The majority of the guard 16 is formed from tubing sections that surround the shaft 14. The tubing is formed from a material that is resistant to corrosion from water and concrete and that is sufficiently rigid and durable to withstand the wear and tear imposed on it by impact with concrete and debris and by the transmission of vibrations through the shaft 14. A durable plastic material such as polyvinyl chloride (PVC) is preferred. The illustrated tubing is circular in transverse cross-section, but could be rectangular or even another shape. The tubing is divided into sections separated by the bearings 70. These sections include multiple interior sections 104 and first and second end sections 102 and 106, all of which surround the exciter shaft 14 and at least generally seal it from the environment. Collars 111 normally cover access openings 113 in the interior sections 104. The collars 111 can be selectively slid out of the way to expose the access openings in order to provide access to the set screws 17 without disassembling the guard 16. The interior tubing sections 104 are each mounted on the truss frame 12 at joints 112, which are described in detail below. Each end section 102 and 106 of the tubing is cantilevered and is covered with an end cap 142 to protect the ends of the exciter shaft 14.

The joints 112 of this embodiment facilitate assembly, provide at least some sealing, and provide for misalignment of the components and limited flexing of the screed. As can be seen in FIGS. 3–6, each joint 112 supports two adjacent tubing sections ends. Each joint includes a bearing 70 and two support cups 116 (one for each adjacent tubing section end). Each joint 112 also includes one spring ring 114. Each spring ring 114 is annular and has an outer peripheral portion that is generally n-shaped in transverse cross-section. Specifically, the outer portion has inner and outer radial legs 118 and 120 connected to one another by an axial outer wall 122. An annular lip 124 extends axially inwardly from the upper end of the inner leg 118 for receiving the end portion 132 of the associated tubing section as detailed below. The spring ring 114 could be made of steel or, as in the illustrated embodiment, is made of a relatively resilient, chemically resistant, and shock resistant material such as polyurethane. The shape and the resilient material of the spring ring 114 provide flexibility in the joint 112 by permitting the spring ring 114 to move, change shape, and then return to its original shape and position. For example, when the truss frame 12 is assembled, the associated components of the truss frame 12 can flex slightly to accommodate misalignment of components. The spring ring 114 accommodates this flexing. The spring ring 114 of the inventive truss screed 10 also provides a biasing force against the ends of the tubular sections.

Figure 5:
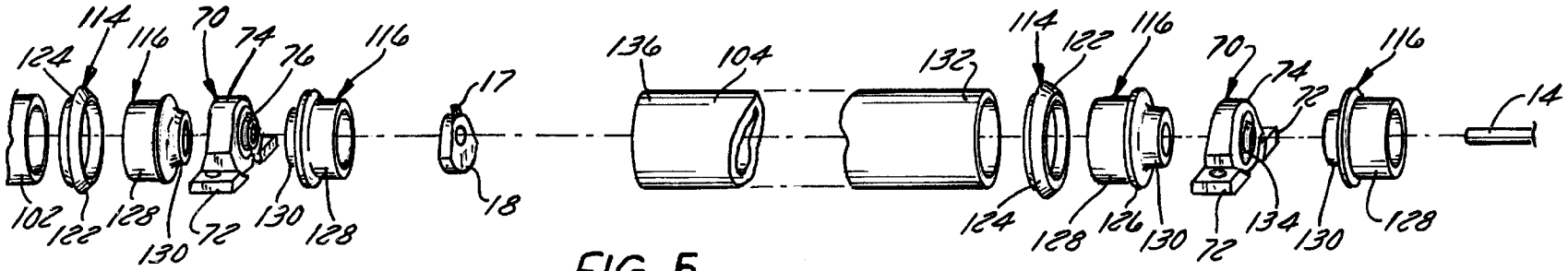
FIG. 5 is an exploded plan view of the shaft guard section of FIG. 3.
Figure 4:
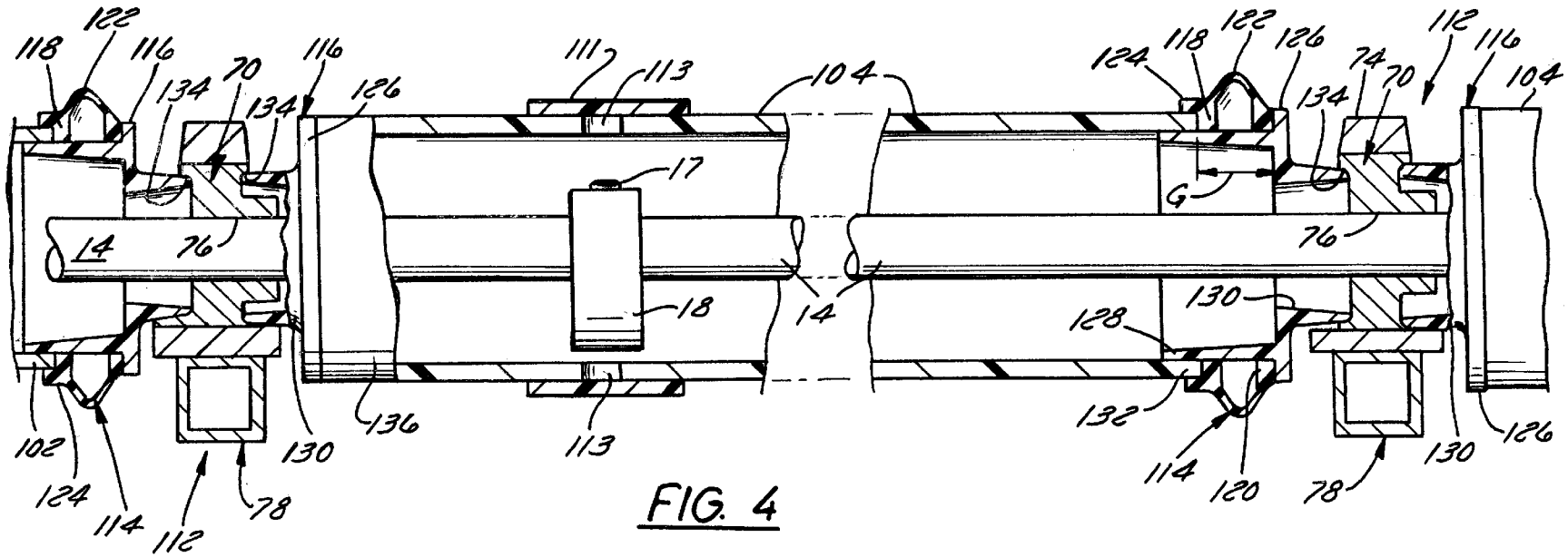
FIG. 4 is a fragmentary cutaway side elevational view of the shaft guard section of FIG. 3 and of the associated section of the exciter assembly.
Figure 6:
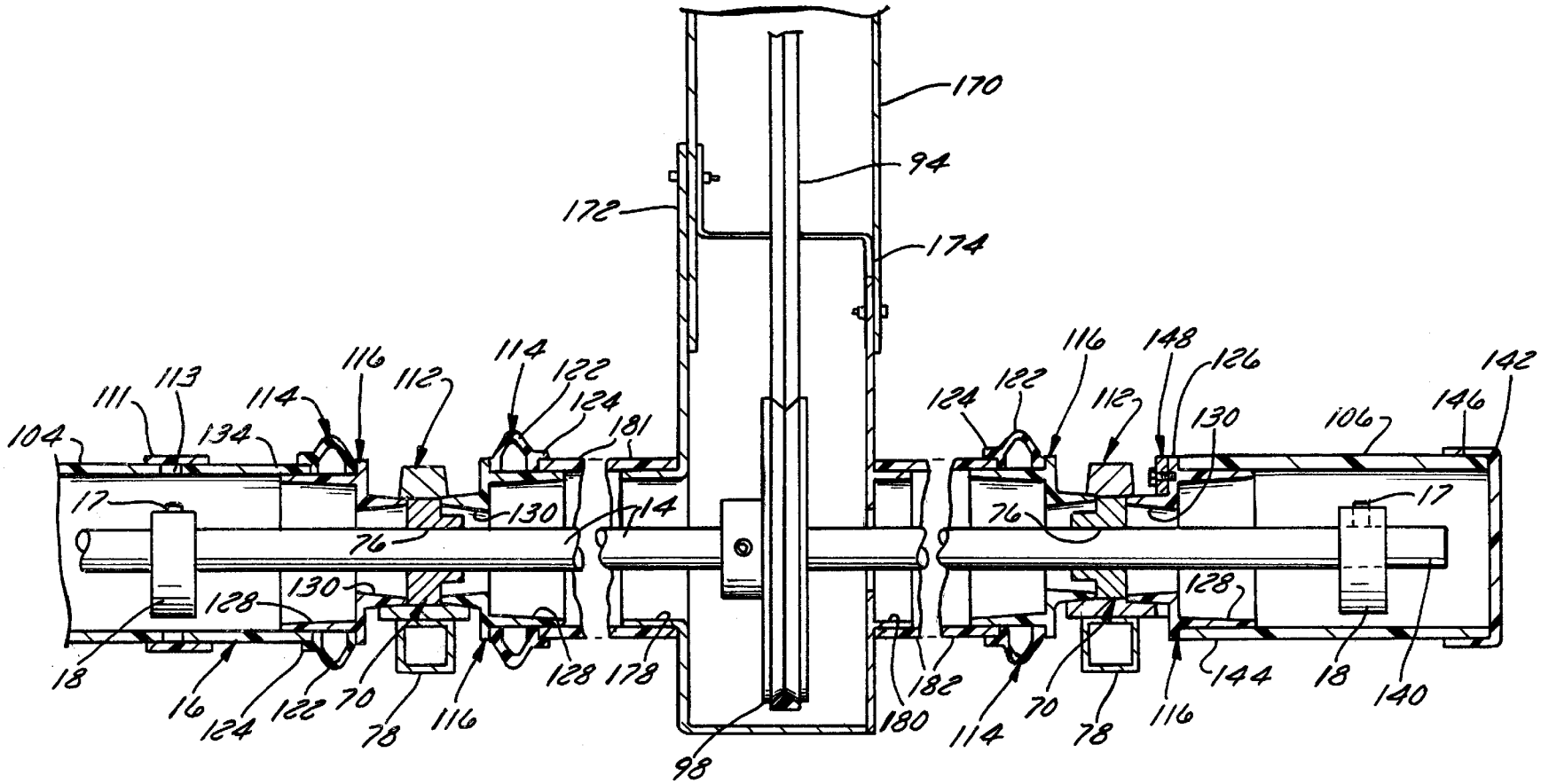
FIG. 6 is a sectional side elevation view of a portion of the shaft guard and a portion of a torque transfer system that supplies drive torque to the exciter assembly.

As can best be seen in FIGS. 4 and 5, each support cup 116 includes a central raised, annular flange 126, an inner, tube-receiving end 128, and an outer, bearing-engaging end 130. The inner end 128 has an OD that is slightly smaller than the ID of the tubing section 104 so as to permit an end portion 132 or 136 of the associated tubing section to slide over the inner end 128, thereby providing a snug fit that helps seal the shaft 14 from the environment. The outer end 130 is dimensioned to fit within an annular recess or counterbore 134 in the outer axial surface of the bearing 70, thereby supporting the support cup 116 and, by association, the remainder of the shaft guard assembly 16, on the bearings 70.

Referring to FIG. 4, a spring ring 114 surrounds the inner end 128 of one support cup 116 for each tubing section end 132 and is located in a gap G formed between the end 132 of the tubing section 104 and the raised annular flange 126. The axial length of the spring ring 114 is set larger than the length of a gap G. As a result, when the shaft guard 16 is assembled by sliding the tubing section end 132 over the support cup inner end 128, the tubing section end 132 first fits within the annular lip 124 and then engages the inner leg 118 to deform the ring 114. This deformation is accommodated by an outward bowing of the outer wall 122 of the spring ring 114 as best seen in FIG. 4. This deformation can accommodate substantial variation in the length of the gap G, thereby negating the need to hold tight tolerances during fabrication and assembly.

Referring to FIG. 4, the end 136 of the tubing section 104 disposed opposite the end 132 is supported on another support cup 116 but, unlike the end 132, abuts directly on the flange 126 of the support cup 116 without an intervening spring ring 114. The left bearing support cup 116 engages a counterbore 134 in the associated bearing 70 in the same manner as the right support cup, thereby supporting the tubing section end 136 on the associated bearings 70.

Figure 7:
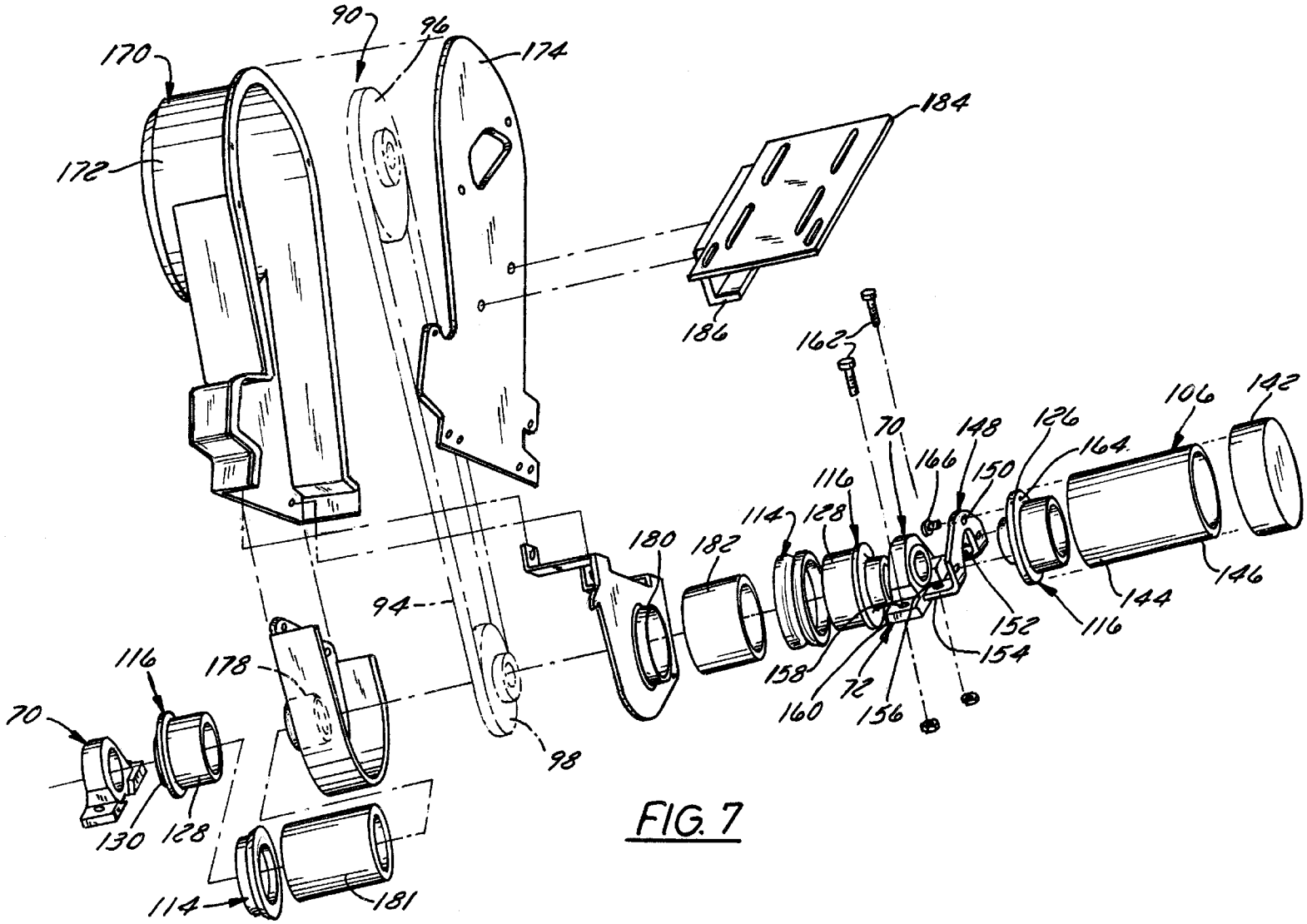
FIG. 7 is an exploded perspective view of a belt guard for the torque transfer system and a guard end section that covers a terminal, cantilevered end of the exciter shaft.
Figure 9:
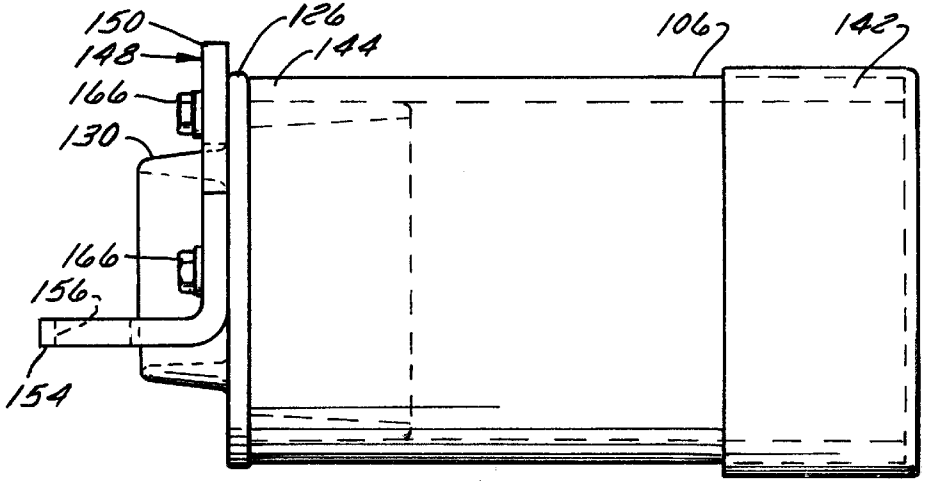
FIG. 9 is a side elevation view of the guard end section of FIG. 7.
Figure 10:
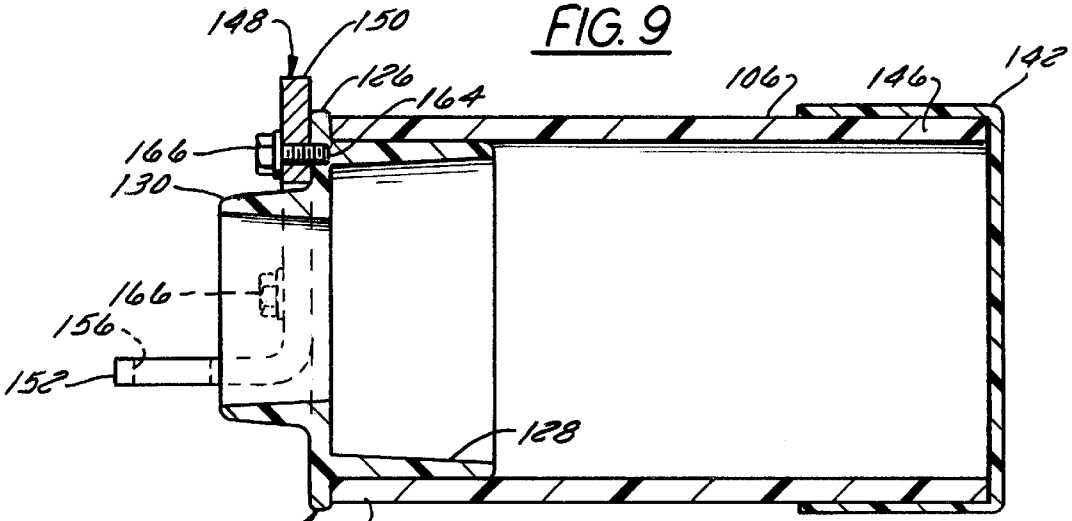
FIG. 10 is a sectional side elevation view of the guard end section of FIG. 9.
Figure 8:
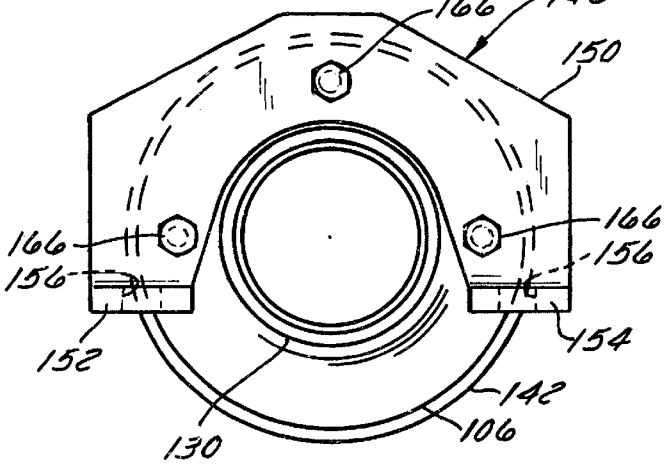
FIG. 8 is an end view of the guard end section of FIG. 7.
Figure 11:
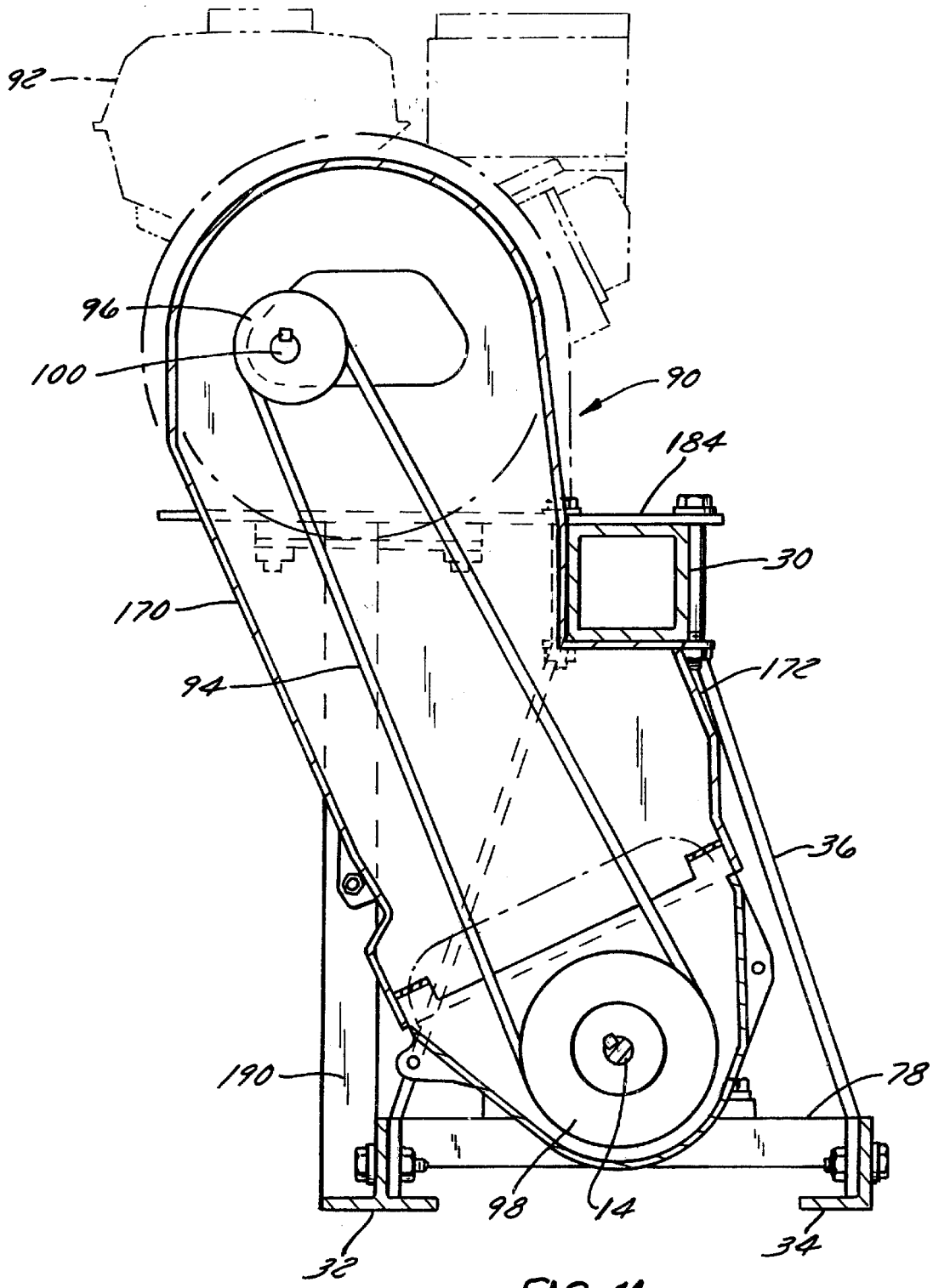
FIG. 11 is a sectional side elevation view of the torque transfer system of FIG. 6 and 7.

FIGS. 6–10 illustrate one of the shaft guard's cantilevered terminal ends, shown generally at 106. The guard end section 106 is supported on a support cup 116 at its inner end 144 and capped at its outer end with an end cap 142. The support cup 116 is essentially identical to the support cups described above to the extent that it includes a central flange 126, an end 130 (in this case an inner end) received in a counterbore 134 in the associated bushing 70, and another end 128 (in these case an outer end) that receives in an inner end 144 of the tubing section 106. However, because the support cup 116 is not clamped in place by a support cup at the opposed outer end 146 of the tubing section 106, it needs to be positively attached to the bearing 70. This attachment comes by way of a generally U-shaped bracket 148. The bracket 148 includes (1) a middle arcuate section 150 extending transversely of the shaft 14 and (2) legs 152, 154 extending at a right angle from each end of the arcuate section 150. Bores 156 in the legs 152 and 154 are aligned with bores 158 in a base 160 of the bearing 70. As is best seen in FIG. 7, a bolt 162 is inserted through each bore 156 in the legs 152, 154 of the mounting bracket 148, through the bore 158 in the bearing base 160, and is held in place by a nut (not shown). Additional bores 164 in the arcuate section 150 of the mounting bracket 148 are aligned with tapped bores in the flange 126 on the support cup 116. A self tapping screw 166 is inserted through each set of the bores 164 and is threaded into a mating bore in the flange 126, thereby fixing the support cup 116 in place. The inner tubing section end 144 is then slipped over the outer end 128 of the bearing support cup 116, where it is held in place by a friction fit or, if necessary, by bolting or some other, more positive connection. The end cap 142 then simply slips over the outer end 146 of the tubing section 106, thereby fully-enclosing the cantilevered end 140 of the exciter shaft 14.

The guard assembly 16 also includes a belt guard 170 that fully encloses the belt 94 and pulleys 96 and 98 as shown in FIGS. 1, 6, 7, and 11. The belt guard 170 includes a casing 172 and a cover 174, both of which are separated into upper and lower sections so as to permit the upper sections to be removed without having to disturb the lower sections and/or disassemble the exciter assembly. Annular flanges 178 and 180 extend outwardly from the lower sections of the casing 172 and the cover 174, respectively. The flanges 178 and 180 both directly support a first end of an associated tubing section 181, 182. The opposite ends of the tubing sections 181 and 182 are, in turn, supported on a a support cup 116 and abut a spring ring 114 as described above. A mounting/support plate 184, affixed to the casing cover 174 by an L-bracket 186, extends outwardly from the cover 174. The plate 184 is bolted to the top tube 30 of the truss frame 12 and welded to a vertical support post 190 (FIG. 11) to stabilize the belt guard 170. The plate 184 also serves as a mounting plate for the motor 92.

5. Second Preferred Embodiment of the Shaft Guard

Figure 12:
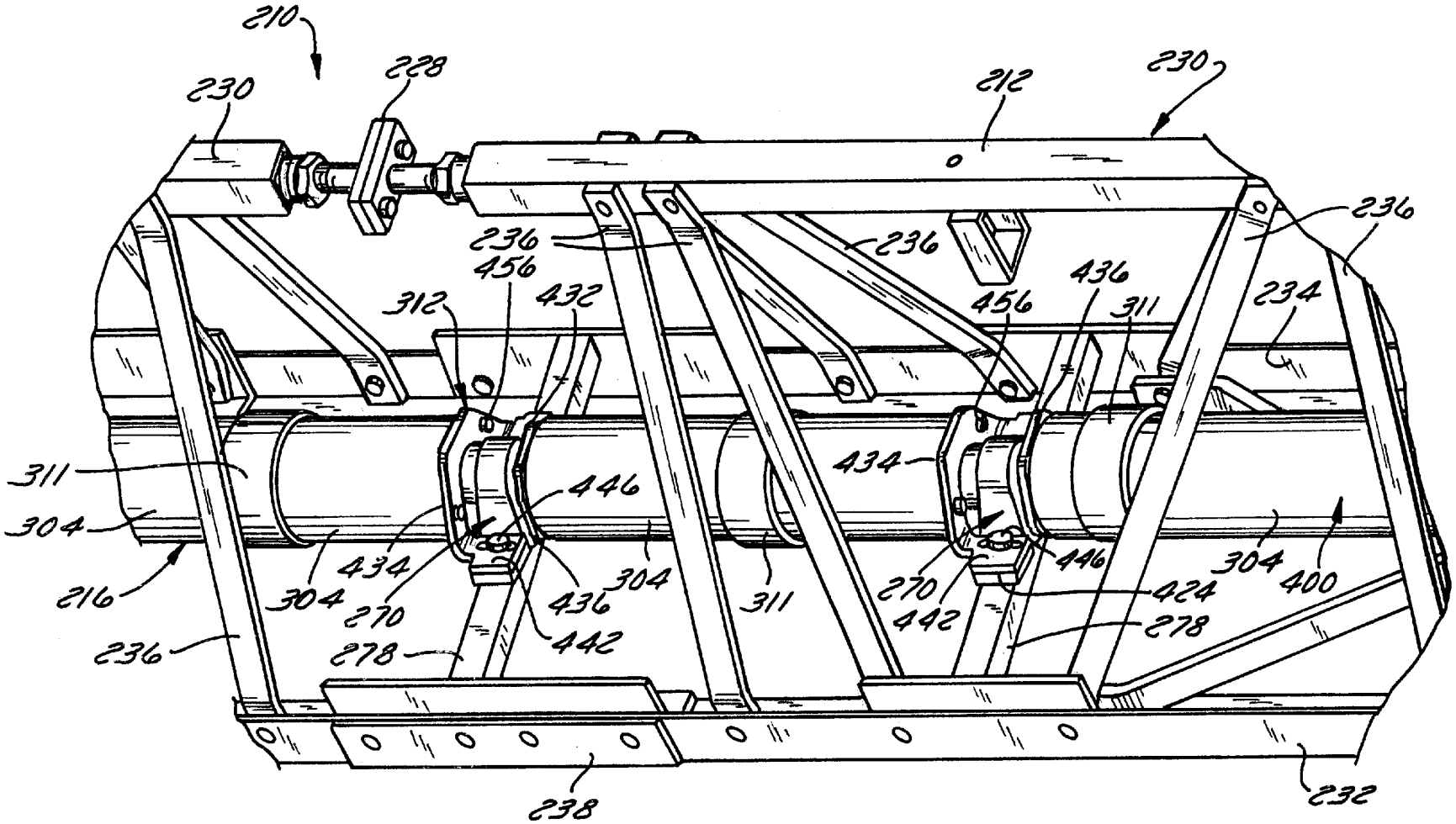
FIG. 12 is a fragmentary perspective view of portion of a truss screed incorporating a shaft guard constructed in accordance with a second embodiment of the invention.
Figure 13:
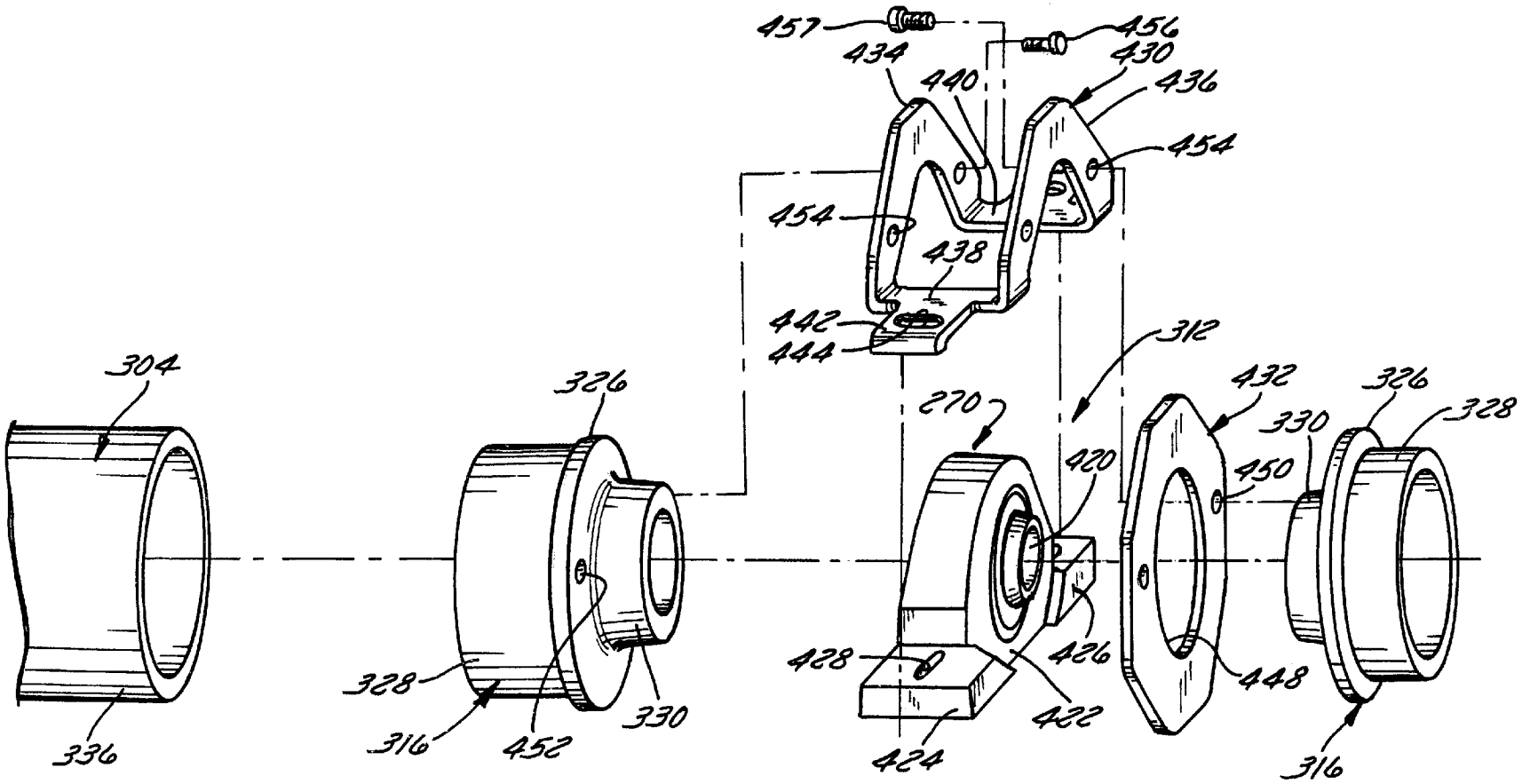
FIG. 13 is an exploded perspective view of a portion of the shaft guard of FIG. 12.
Figure 14:
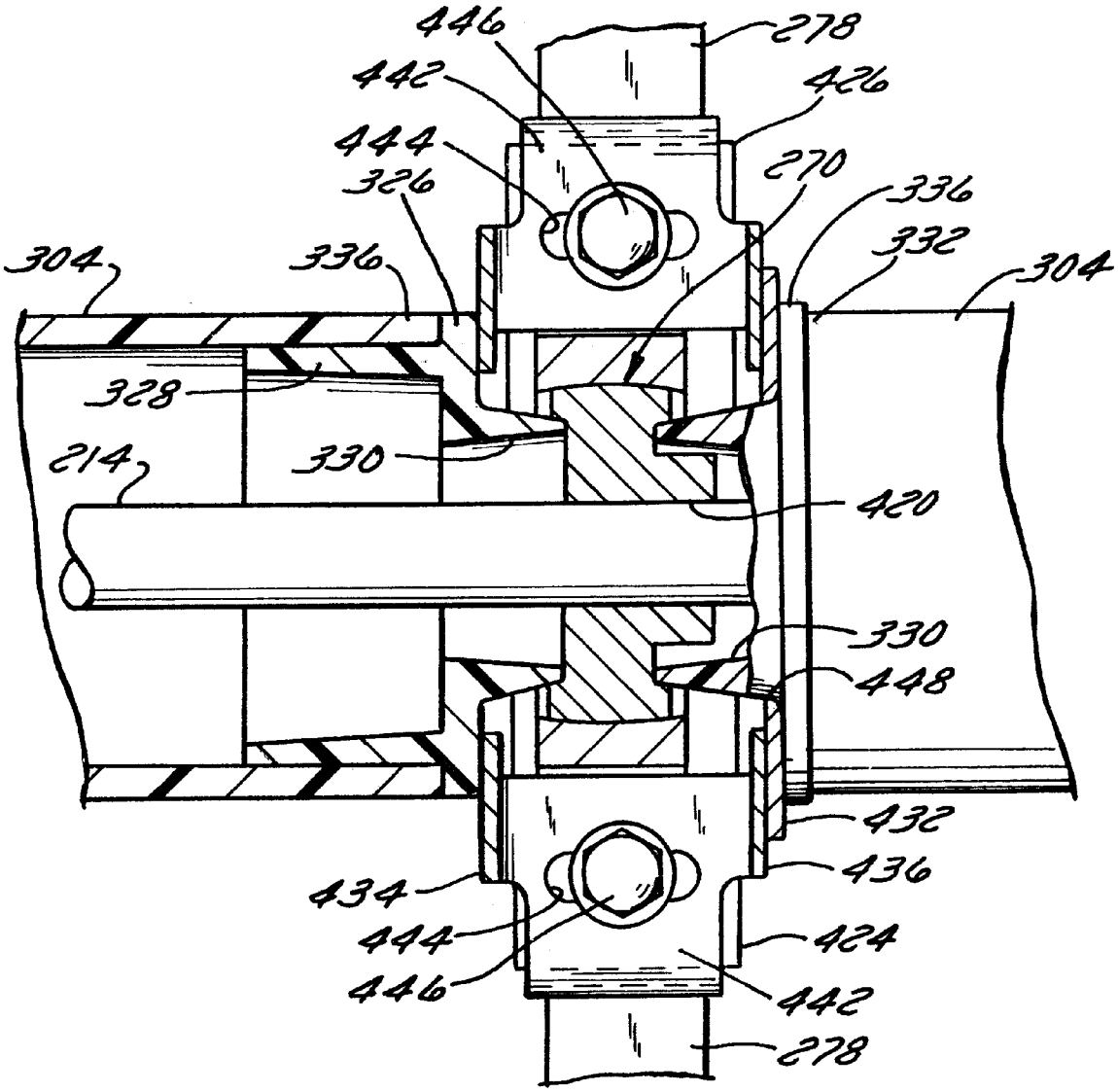
FIG. 14 is a sectional top plan view of the shaft guard portion of FIG. 13.

Referring to FIGS. 12–14, a portion of a second preferred embodiment of the truss screed 210 is illustrated that is identical to the truss screed 10 of the first preferred embodiment except for the fact that it employs slightly different bearings to support its exciter shaft 214 on the truss frame 212 and that its exciter shaft 214 is protected by a different shaft guard 216. Elements of the truss screed 210 of FIGS. 12–14 corresponding to elements of the truss screed 10 of FIGS. 1–11 are, accordingly, designated by the same reference numerals, incremented by 200. A description of components that are identical to both embodiments will be omitted for the sake of conciseness.

The shaft guard 216 of this embodiment, like the shaft guard 16 of the first embodiment, includes sections of tubing 300 that cover the exciter shaft 214 and that are supported on bearings 270 at joints 312. Each interior section 304 has opposed ends 332 and 336 supported on spaced bearings 270 using support cups 316 that are identical to the support cups 116 of the first embodiment. The end sections (not shown) are supported on the end-most bearings of the screed in a manner that is the same as or similar to the first embodiment.

Each bearing 270 of this embodiment comprises a pillow bearing having a through bore 420 and a base 422 having mounting flanges 424 and 426 that flank the exciter shaft 214 and that rest on a tubular support bar 278 extending between the screed plates 232 and 234 at the connector plates 238. Slots 428 in the mounting flanges 424 and 426 are elongated in a direction that is perpendicular to the exciter shaft 214 in order to accommodate misalignment of the exciter shaft 214 with respect to the mounting holes in the support bar 278.

Another significant difference between this embodiment and the first embodiment is the elimination of the spring rings in favor of mounting brackets 430 and cup guides 432 which, in combination, serve as attachment hardware for connecting the support cups 316 to the bearings 270 while still accommodating normal angular adjustment of the truss frame 212 and misalignments that may occur during assembly (cup guides 432 are only utilized on one side of those bearings 270 located at a juncture between adjacent screed sections). These structures and their relationship to the remainder of the truss screed 210 will now be detailed.

Referring to FIGS. 13 and 14, the mounting bracket 430 is generally U-shaped so as to be capable of fitting over the associated bearing 270. The U-shaped bracket 430 includes two vertical end wall portions 434 and 436 linked to one another by two horizontal base portions 438 and 440. The end wall portions 434 and 436 flank the axial ends of the associated bearing 270 and are each curved to form an opening for receiving the exciter shaft 214 and support cup outer end 330. Each base portion 438 and 440 rests upon the associated bearing flange 424, 426. A flange 442 extends laterally from each horizontal base portion 438, 440. Each flange 442 includes a slot 444 that is elongated in a direction that is parallel to the exciter shaft 214.

The U-shaped bracket 430 is mounted on the pillow bearing 270 and the I-shaped connector plate 278 by inserting a bolt 446 through each slot 444 of the U-shaped bracket 430, the underlying slot 428 in the pillow bearing flange 424 or 426, and into threaded engagement with a nut located under the I-shaped connector plate 278. Slots 428 and 444 provide flexibility and movement in directions that are perpendicular to each other. Preferably, each slot 444 has about 1/16" of play to provide a total movement of about 1/10" for both slots 444.

The cup guides 432 are utilized only at the joints between adjacent screed sections. Only one cup guide 432 is present at each such joint 270, and functions to support the support cup 316 while permitting angular movement of the support cup 316 and associated tubing, section relative to the bearing 270 during angular adjustment of the screed sections relative to one another. The cup guide 432 surrounds the exciter shaft 214 at a location between the support cup 316 and an associated end portion 436 of the U-shaped bracket 430. The cup guide 432 is a hexagonally-shaped, planar structure with an annular opening 448 therethrough for fitting over and centering the support cup outer end 330. The cup guide 432 is attached to the mounting bracket 430 by inserting bolts 457 through holes 450 in the cup guide 432 and holes 454 in the associated end portion 436 of the mounting bracket 430. The outer end of the support cup 316 can then be inserted through the annular opening 448 in the cup guide 432 so as to remain in position while permitting relative tilting motion therebetween during angular adjustment of the screed sections. The remaining support cups 316 are rigidly attached to the brackets 430 by inserting a self threading screw 456 through a hole 454 in the bracket 430 and into a tapped bore 452 in the support cup 316.

The inner end 328 of support cup 316 can then receive the associated end 332 or 336 of a tubing section in the same manner as in the first embodiment. If desired, the tubing sections can be dimensioned relative to the bearing spacings to maintain a small gap between the end 332 or 336 of each tubing section and the associated flange 326 in order to allow limited axial movement between the tubing sections and the support cup 316 during assembly and screed operation.

7. Assembly and Operation of the Truss Screed

The assembly of the truss screed will now be detailed primarily using the first preferred embodiment of the shaft guard 16. The truss screed sections 24, 26 are assembled by rotating the tumbuckles 28 at the top tube 30 of the screed frame 12 and fastening the connector plates 38 to the screed plates 32, 34. The exciter shaft 14 is mounted on the assembled sections 24, 26 via the bearings 70 and the support brackets 78. During this mounting process, the shaft guard 16 of the first preferred embodiment is assembled by joining the tubing sections at the flexible joints 112. The spring rings 114 of the joints 112 of the first embodiment accommodate misalignment and limited relative movement of the shaft guard 16 relative to the remaining components. The U-bracket 430 and end cap guide 432 of the joints 312 of the second embodiment also accommodate at least some misalignment and relative movement between the other components.

In operation, both shaft guards 16 and 216 cover the entire exciter shaft 14 or 214 to protect it from concrete and debris. This extends the life of the exciter shaft 14 or 214, thereby reducing the costs of operating the truss screed 10 or 210 both in terms of reducing the amount of down time and reducing the costs associated with replacing the exciter shaft 14 or 214 and associated parts. Furthermore, articles in the vicinity of the truss screed 10 or 210 are protected from the rotating shaft 14 or 214.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention.

The invention is not intended to be limited to the preferred embodiments described above, but rather is intended to be limited only by the claims set out below.

Thus, the invention encompasses all alternate embodiments that fall literally or equivalently within the scope of these claims.

What is claimed is:

1. A method of leveling a poured concrete slab comprising:

(A) translating a truss screed over a top of a form containing poured concrete, the truss screed including
  (1) a frame;
  (2) at least one screed plate which rests on top of the form and which is supported on the frame,
  (3) an exciter shaft which is supported on the frame;
  (4) a shaft guard which covers the exciter shaft and which includes
    (a) sections of tubing that cover the exciter shaft, and
    (b) a plurality of joints that support the sections of tubing on the frame and that include a bearing supporting the exciter shaft on the frame; and
  (5) a torque transfer system;

(B) as the truss screed is being translated over the form, driving the exciter shaft to rotate by operating the torque transfer system;

(C) as a result of exciter shaft rotation, imparting a vibratory motion to the screed plate through the bearings; and (D) prior to step (A), permitting at least limited flexing movement of the frame and at least limited movement of the tubing sections relative to one another while adjusting the truss screed to vary an angular orientation of two adjacent screed sections relative to one another, wherein limited movement of the tubing sections is accommodated by permitting at least one of the joints to flex, wherein the step of permitting the joint to flex comprises distorting a resilient spring ring disposed between an end of one of the tubing sections the bearing supporting that end section.

2. A truss screed comprising:

(A) a frame;

(B) at least one screed plate which is configured to support the frame on a concrete surface to be leveled;

(C) an exciter shaft which is supported on the frame and which is rotatable to impart vibrations to the screed plate;

(D) a shaft guard which covers the exciter shaft and which includes
  (1) sections of tubing which surround the exciter shaft, and
  (2) joints which support adjacent sections of tubing on the frame while permitting relative movement therebetween, each of the joints including a bearing that supports the exciter shaft on the frame; and (E) a torque transfer system that transfers torque to the exciter shaft to impart vibrational forces to the screed plate, wherein each joint comprises a support cup which is supported on the bearing and which supports an end of an associated tubing section so as to permit at least limited relative movement between the associated tubing section and the bearing.

3. The truss screed of claim 2, wherein at least one of the joints further comprises a resilient spring ring disposed axially between an axial end of the associated tubing section and an axial surface of the support cup.

4. The truss screed of claim 3, wherein another end of the associated tubing section is supported on a second support cup associated with a second joint, and wherein the second end faces an axial surface on second support cup without a spring ring being disposed therebetween.

5. The truss screed of claim 3, wherein the resilient spring ring is made of a deformable polymeric material.

6. The truss screed of claim 2, wherein each of at least some of the joints further comprises a bracket which is mounted on the bearing and to which the support cup is fastened.

7. The truss screed of claim 6, wherein each of the at least some joints further comprises an annular cup retainer which is disposed between the associated bracket and the associated support cup and which is fastened to the associated bracket and the associated support cup.

8. The truss screed of claim 6, wherein each of the brackets is substantially U-shaped, having first and second end portions flanking axial ends of the associated bearing and first and second base portions that connect the first and second end portions to one another and that are fastened to the associated bearing.

9. The truss screed of claim 8, wherein an elongated slot is formed through each of the base portions for receiving a bolt therethrough and for accommodating limited movement of the bracket relative to the bolt in a direction that extends axially of the exciter shaft.

10. A truss screed comprising:

(A) a frame;

(B) at least one screed plate which is configured to support the frame on a concrete surface to be leveled;

(C) an exciter shaft which is supported on the frame and which is rotatable to impart vibrations to the screed plate;

(D) a shaft guard which covers the exciter shaft and which includes (1) sections of tubing which surround the exciter shaft, and (2) joints which support adjacent sections of tubing on the frame while permitting relative movement therebetween, each of the joints including a bearing that supports the exciter shaft on the frame; and (E) a torque transfer system that transfers torque to the exciter shaft to impart vibrational forces to the screed plate, wherein at least one end portion of the exciter shaft is cantilevered, and wherein the shaft guard includes a cantilevered end section including (1) a support cup fastened to a bearing located adjacent the cantilevered end of the exciter shaft;

(2) a cantilevered tubing section that surrounds the exciter shaft and that has a first end which is supported on the support cup and a second end located axially beyond the cantilevered end of the exciter shaft; and (3) an end cap that covers the second end of the cantilevered tubing section.

11. The truss of claim 1, further comprising a guard that at least essentially completely surrounds all moving parts of the torque transfer system.

12. A truss screed comprising:

(A) a generally triangular truss frame configured to extend across a concrete slab to be leveled;

(B) front and rear screed plates forming a bottom surface of the truss frame;

(C) an exciter shaft which is supported in the screed in close vertical proximity to the screed plates and which includes eccentric weights positioned along the exciter shaft;

(D) a shaft guard which covers the exciter shaft and which includes (1) sections of tubing that surround the exciter shaft and that each have first and second ends, (2) a plurality of joints, at least one of which supports adjacent ends of two adjacent tubing sections, wherein at least some the joints include (a) a bearing that is mounted on the truss frame and that rotatably supports the exciter shaft, (b) a bracket that fits over the bearing and that is mounted on the bearing, (c) a cup guide which is located adjacent one end portion of the bracket, (d) first and second support cups, each of which has (i) a tubular end portion that supports an end portion of an associated tubular section and (ii) an axial surface that is raised with respect to the tubular end portion and that faces an axial end of the end portion of the associated tubular section, and (e) a plurality of fasteners that connect the first support cup to the associated cup guide and bearing, thereby supporting the associated tubular section end portion on the associated bearing, wherein the second support cup is supported on an associated cup guide without being fastened to the associated bearing; and (E) a torque transfer system which transfers torque to the exciter shaft to impart vibrational forces to the screed plates, the torque transfer system including a motor and an endless torque transfer element coupling the motor to the exciter shaft.

13. The truss screed of claim 12, wherein each of the brackets is generally U-shaped and comprises (A) first and second vertical portions which flank opposed axial ends of the associated bearing;

(B) first and second base portions which extend axially of the exciter shaft and that connect the vertical portions to one another; and (C) first and second flanges, each extends perpendicularly from an associated base portion and is affixed to the associated bearing.

14. The truss screed of claim 12, wherein slots are formed in the bearing and in overlying portions of the flanges and are elongated at right angles to each other.

15. The truss screed of claim 12, wherein at least one end portion of the exciter shaft is cantilevered, and wherein the shaft guard includes a cantilevered end section including (A) a support cup fastened to a bearing located adjacent the cantilevered end of the exciter shaft;

(B) a cantilevered tubing section which surrounds the exciter shaft and which has a first end supported on the support cup and a second end located axially beyond the cantilevered end of the exciter shaft; and (C) an end cap that covers the second end of the cantilevered tubing section.

16. The truss screed of claim 12, further comprising a guard that completely encases the endless torque transfer element.

17. A method of leveling a poured concrete slab comprising:

(A) translating a truss screed over a top of a form containing poured concrete, the truss screed including (1) a frame;

(2) at least one screed plate which rests on top of the form and which is supported on the frame, (3) an exciter shaft which is supported on the frame;

(4) a shaft guard which covers the exciter shaft and which includes (a) sections of tubing that cover the exciter shaft, and (b) a plurality of joints that support the sections of tubing on the frame and that include a bearing supporting the exciter shaft on the frame; and (5) a torque transfer system;

(B) as the truss screed is being translated over the form, driving the exciter shaft to rotate by operating the torque transfer system;

(C) as a result of exciter shaft rotation, imparting a vibratory motion to the screed plate through the bearings; and (D) prior to step (A), permitting at least limited flexing movement of the frame and at least limited movement of the tubing sections relative to one another while adjusting the truss screed to vary an angular orientation of two adjacent screed sections relative to one another.

18. The method of claim 17, wherein limited movement of the tubing sections is accommodated by permitting at least one of the joints to flex.

19. The method of claim 17, wherein the step (C) includes rotating a plurality of eccentric weights on the exciter shaft to generate vibrations in the exciter shaft that are transmitted to the screed plate through the bearings.

20. The method of claim 18, wherein the step of permitting the joints to flex comprises at least one of 1) allowing an end of an associated tubing section to move a limited amount relative to the joint and 2) allowing a support bracket for the joint to flex a limited amount.

21. A truss screed comprising:

(A) a frame;

(B) at least one screed plate which is configured to support the frame on a concrete surface to be leveled;

(C) an exciter shaft which is supported on the frame and which is rotatable to impart vibrations to the screed plate;

(D) a shaft guard which covers the exciter shaft and which includes (1) sections of tubing which surround the exciter shaft, and (2) joints which support adjacent sections of tubing on the frame while permitting relative movement therebetween, each of the joints including a bearing that supports the exciter shaft on the frame; and (E) a torque transfer system that transfers torque to the exciter shaft to impart vibrational forces to the screed plate.

22. The truss screed of claim 21, further comprising a plurality of eccentric weights that are provided on the exciter shaft and that generate vibrations upon exciter shaft rotation that are transmitted to the screed plate via the exciter shaft.

* * * * *